US006036247A

United States Patent [19]

Gertz et al.

[11] Patent Number: 6,036,247

[45] Date of Patent: Mar. 14, 2000

[54] ADJUSTABLE INNER DIAMETER BARREL LIFTING ASSEMBLY

[75] Inventors: David C. Gertz, San Clemente; Jack H. Kulp, San Juan Capistrano, both of Calif.

[73] Assignee: Traffix Devices, Inc., San Clemente, Calif.

[21] Appl. No.: 09/249,223

[22] Filed: Feb. 11, 1999

[51] Int. Cl.[7] ..... B66C 1/66

[52] U.S. Cl. ..... 294/67.31; 294/90; 294/106; 294/119.2

[58] Field of Search ..... 294/16, 28, 31.1, 294/31.2, 50.7, 67.1, 67.3, 67.31, 68.26, 68.27, 68.3, 74, 90, 91, 106, 113, 119.2, 902

[56] References Cited

U.S. PATENT DOCUMENTS

| | | | |
|---|---|---|---|
| 189,688 | 4/1877 | Bogert et al. | 294/113 |
| 201,648 | 3/1878 | Bulkeley | 294/113 X |
| 1,070,124 | 8/1913 | Fair | 294/90 |
| 2,340,915 | 2/1944 | Whittaker | 294/68.3 |
| 2,749,173 | 6/1956 | Peterson | 294/113 |
| 3,352,591 | 11/1967 | Casey | 294/90 X |
| 3,744,836 | 7/1973 | Goetti | 294/119.2 |
| 5,171,053 | 12/1992 | Rouleau | 294/90 X |
| 5,303,968 | 4/1994 | Trine | 294/90 X |

OTHER PUBLICATIONS

Fitch Universal Modules; Roadway Safety Service, Inc. Ronkonkoma, NY 11779.

The New Dozier Equipment Co.; Manufactured by Hercules Industries; Hercules . . . The Better WAy to Handle Heavy Drums.

Barrier West Inc.; Innovations in Lifting; American Road & Transportation Builders Association.

Lift 'N Flip; Features of the Barrier West Lift–N–Flip; http://www.barrierwest.com/flip.htm; Mar. 11, 19961.

Fitch San Filled Crash Barriar; Universal Module; Roadway Safety Service, Inc.; Ronkonkoma, NY 11779.

*Primary Examiner*—Johnny D. Cherry

*Attorney, Agent, or Firm*—Stout, Uxa, Buyan & Mullins, LLP; Donald E. Stout

[57] ABSTRACT

A lifting ring assembly is designed for lifting barrels that have at least a partial circumferential radial extension above an outer diameter. The lifting ring comprises a split ring and a cross brace. The split ring comprises two half ring segments having mutually attachable ends. The inner diameter of the split ring is smaller than the outer diameter of the partial circumferential radial extension. The cross brace comprises first and second rigid arms having top ends and bottom ends. The top ends are mutually pivotally connected by a pivoting mechanism. The bottom ends are fixedly connected to a midpoint of the half ring segments, respectively, such that the cross brace is perpendicularly oriented to the split ring and the rigid arms pivot in a vertical plane. The lifting ring may be modified to lift with a fork lift truck with a cable loop that extends from the pivoting mechanism. Two semi-circular inserts that are removably attached to respective half ring segments may be disposed on the split ring and extend radially inwardly. The attached semi-circular inserts reduce the inner diameter of the split ring allowing for drums of different outer diameters. An aspect of the invention may be fabricated with aluminum for strength, low weight, and cost.

11 Claims, 6 Drawing Sheets

ADJUSTABLE INNER DIAMETER BARREL LIFTING ASSEMBLY

BACKGROUND OF THE INVENTION

1. Field of the Invention

This invention relates to lifting devices and, more specifically, to the devices used for lifting and positioning sand barrels.

2. Description of the Related Art

Previous lifting devices for lifting sand barrels include two different types. The first type of sand barrel lifting devices use a rigid beam with short tabs on each side. The tabs have pins that insert into holes in the side of the barrel. A disadvantage of this device is that it is not safe since the top of the barrel can break at the pin position.

The second type of sand barrel lifting devices uses a steel circular strap that bolts around the middle of a sand barrel and is supported by a flange on the barrel perimeter. A steel wire cable is attached to vertical side tabs on the steel circular strap and is used for lifting the sand barrel. This type of device needs a long lifting cable to clear the sides of the barrel. The long lifting cable removes the possibility of using standard fork lift trucks to move the sand barrels as the forks of the truck do not reach high enough to lift a drum. This arrangement is also prone to creating an undesirable swinging of the sand barrel during movement.

Therefore, what is needed is a sand barrel lifter that may be used with a fork lift truck that also reduces the potential of the sand barrel swinging and portions of the sand barrel breaking off.

SUMMARY OF THE INVENTION

In an aspect of the invention, a lifting ring assembly is designed for lifting barrels that have at least a partial circumferential radial extension above an outer diameter. The lifting ring comprises a split ring and a cross brace. The split ring comprises two half ring segments having mutually attachable ends. The inner diameter of the split ring is smaller than the outer diameter of the partial circumferential radial extension. The cross brace comprises first and second rigid arms having top ends and bottom ends. The top ends are mutually pivotally connected by a pivoting mechanism. The bottom ends are fixedly connected to a midpoint of the half ring segments, respectively, such that the cross brace is perpendicularly oriented to the split ring and the rigid arms pivot in a vertical plane.

In a further aspect of the invention, the pivoting mechanism comprises a tab and a pivoting member. The tab extends from each rigid arm top end. The tabs are perpendicularly oriented to the split ring and overlap in a direction normal to the vertical plane. The pivoting member is rotationally mounted through the overlapping tabs in the direction normal to the vertical plane.

In a further aspect of the invention, a cable loop is connected to the pivoting mechanism for lifting the lifting ring without moving the rigid arms relative to each other. In a still further aspect of the invention, the cable loop has two ends. Each cable end has an eyelet through which extends the pivoting member.

In an aspect of the invention, the pivoting mechanism of the lifting ring comprises a first set of two tabs, a second set of two tabs, a cable loop, and a pivoting member. The first set of two tabs extend from the first rigid arm top end. The first set of two tabs are perpendicularly oriented to the split ring and overlap in a direction normal to the vertical plane.

The second set of two tabs extend from the second rigid arm top end. The second set of two tabs are perpendicularly oriented to the split ring, mutually overlap, and overlap the first set of two tabs in the direction normal to the vertical plane. The second set of two tabs are disposed between the first set of two tabs. The cable loop is connected to the pivoting mechanism for lifting the lifting ring without moving the rigid arms relative to each other. The pivoting member is rotationally mounted through the overlapping tabs in the direction normal to the vertical plane. In a still further aspect of the invention, the cable loop has two ends. Each cable end has an eyelet through which extends the pivoting member.

In an aspect of the invention, the cable loop is adapted to have a fork of a fork lift truck inserted therethrough and lift the lifting ring.

In an aspect of the invention, each half ring segment comprises a tube and a curved lip. The tube is bent in a generally half circle shape. The curved lip extends radially inwardly from a top surface of the tube for the partial circumferential radial extension to rest on during lifting.

In a further aspect of the invention, the split ring further comprises two semi-circular inserts that are removably attached to respective half ring segments, are disposed on the curved lip, and extend radially inwardly greater than the curved lip, whereby the attached semi-circular inserts reduce the inner diameter of the split ring. In a still further aspect of the invention, the tube is aluminum and the curved lip is a first leg of a curved aluminum angle. The angle has a second leg extending from an inner edge of the curved lip away from the cross brace and extending at a generally 90° angle from the first leg.

In an further aspect of the invention, the split ring further comprises two semi circular aluminum inserts that are removably attached to respective half ring segments. The inserts are also disposed on the curved lip and extend radially inwardly greater than the curved lip. This results in the attached semi-circular inserts reducing the inner diameter of the split ring.

DESCRIPTION OF THE PREFERRED EMBODIMENTS

Figure 1:
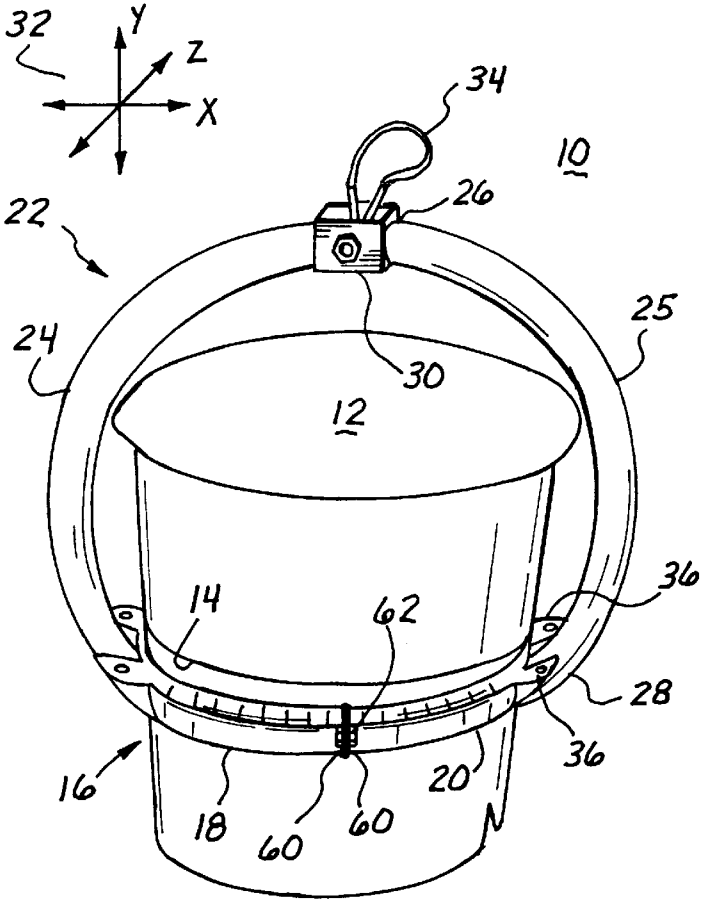
FIG. 1 shows a perspective view of a lifting ring assembly disposed about a single piece sand drum according to an embodiment of the invention.
Figure 8:
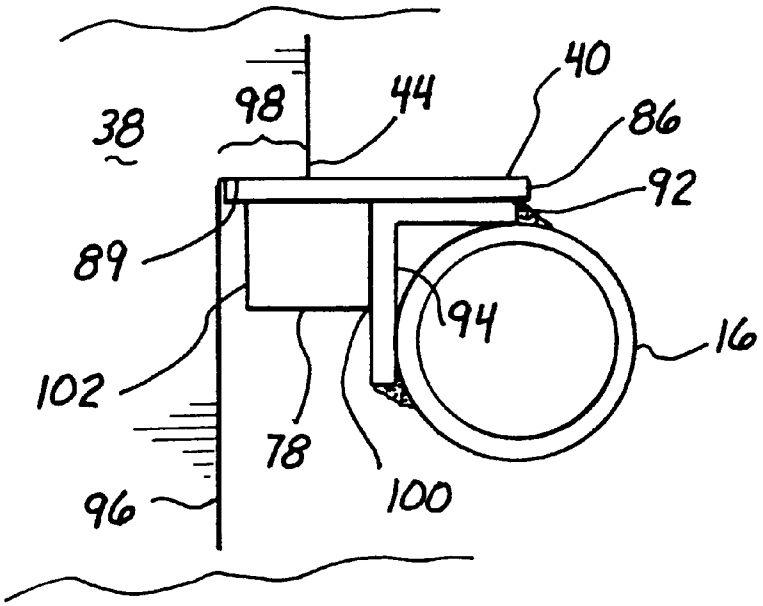
FIG. 8 shows a cross sectional detail of the split ring of the lifting ring assembly of FIG. 2 with a split ring insert.
Figure 7:
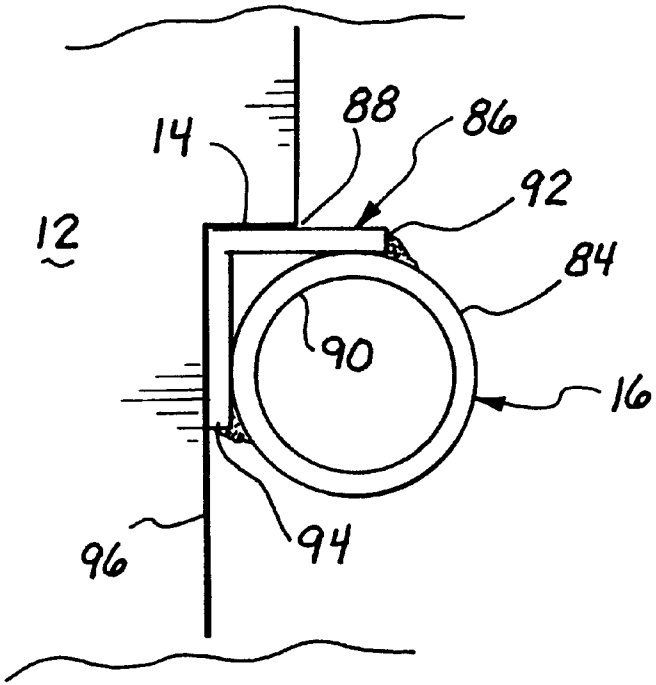
FIG. 7 shows a cross sectional detail of the split ring of the lifting ring assembly of FIG. 1.

Referring now to the figures, wherein like reference numerals refer to like elements throughout the figures, and referring specifically to FIG. 1, a sand barrel drum lifting ring assembly 10 is disposed about a large sand barrel 12. The barrel 12 has a circumferential radial extension 14 about midway high on the barrel 12. In the shown embodiment of the invention, the extension 14 is the result of a stepped decrease in diameter of the barrel 12 in a downward direction. Other embodiments of the invention may have other suitable configurations to create the circumferential radial extension, such as a flange. Still other embodiments of the invention may have a partial circumferential radial extension. FIGS. 7 and 8 show a detail of the circumferential radial extension 14.

The lifting ring 10 is comprised of a split ring 16 that is shown below the radial extension 14 and disposed about the barrel 12 in a generally horizontal position. The split ring has a first half ring segment 18 shown on the left and a second half ring segment 20 shown on the right. The split ring 16 is shown below the radial extension 14 because the split ring has not been drawn up to the extension.

The lifting ring 10 is also comprised of a cross brace 22 that extends vertically upward from the split ring 12. The cross brace 22 has a first rigid arm 24 shown on the left and a second rigid arm 25 shown on the right. Each arm 24 and 25 has a top end 26 and a bottom end 28. The top ends 26 are pivotally joined with a pivoting mechanism 30 such that the arms 24 and 25 can pivot in a vertical plane xy as shown by the axes 32. Extending from the pivoting mechanism 30 is a cable loop 34 for lifting the lifting ring 10. The arm bottom ends 28 are fixedly connected to midpoints on the half ring segments 18 and 20, respectively. Extending radially from the split ring 16 are split insert ring holding tabs 36, which are described in detail below.

Figure 2:
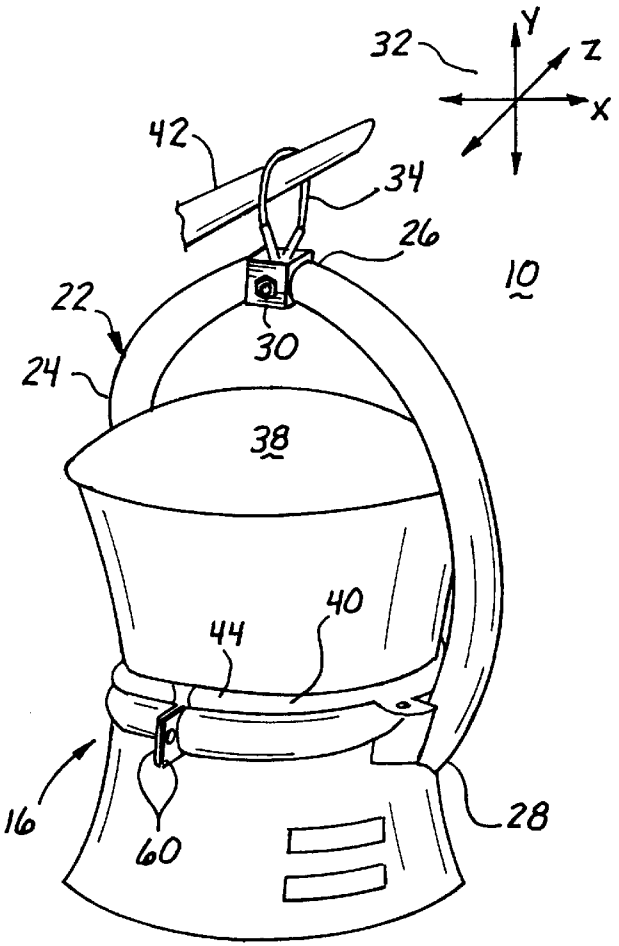
FIG. 2 shows a perspective view of the lifting ring assembly of FIG. 1 with a split ring insert reducing the inner diameter of the ring and the lifting ring assembly being disposed about a smaller diameter two piece sand drum.

Now referring to FIG. 2, the lifting ring assembly 10 is disposed about a two piece sand barrel 38 that has a smaller diameter than the large sand barrel 12 of FIG. 1. The sand barrel 38 has a circumferential radial extension 44 of the two piece barrel 38 that is analogous to the circumferential radial extension 14 of the large sand barrel 12.

The split ring 16 of the lifting ring assembly 10 has a split insert ring 40 disposed on top of it. The split insert ring provides the split ring 16 with a smaller inner diameter, thus enabling the lifting ring to lift and move barrels of other diameters, such as the two piece sand barrel 38. Details of the split ring insert 40 are discussed below in connection with FIGS. 5–8.

The lifting ring assembly 10 in FIG. 2 is shown with a fork lift tongue 42 extending through the cable loop 34. The fork lift tongue 42 has drawn the lifting ring 10 upward and disposed the split insert ring 40 into contact with a circumferential radial extension 44 of the two piece barrel 38.

Figure 3:
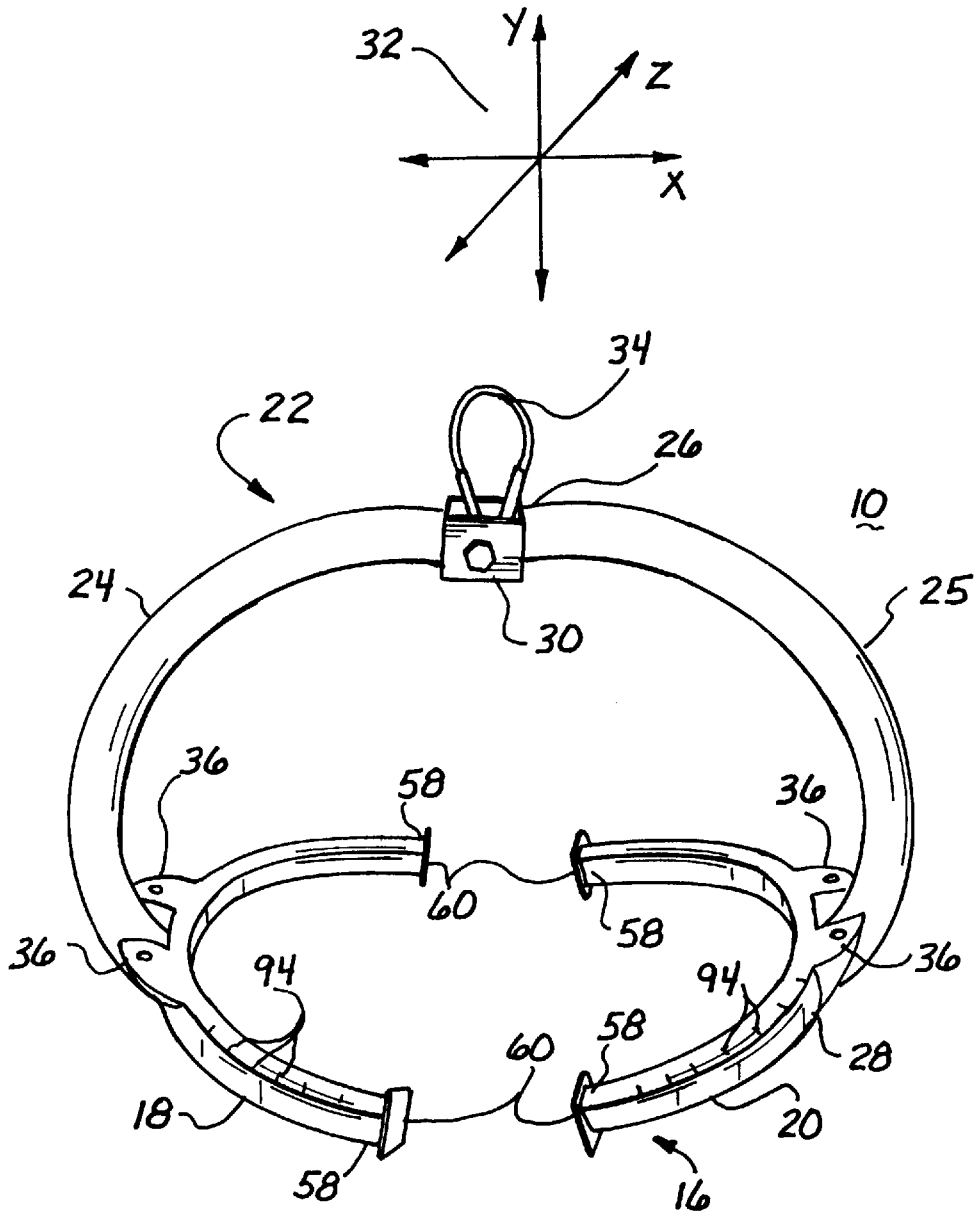
FIG. 3 shows a perspective view of the lifting ring assembly of FIG. 1 without a sand barrel and in the open position.

Referring now to FIG. 3, the lifting ring assembly 10 is shown without a barrel and with the arms 24 and 25 of the cross brace 22 being outwardly pivoted in the X-Y plane, as shown by the axes 32, at the pivoting mechanism 30. As a result of the pivoting, the half ring segments 18 and 20 are drawn apart. Each of the half ring segments 18 and 20 has ends 58 with contact plates 60 attached thereto. Each contact plate 60 contacts and aligns with a matching contact plate 60 when the split ring 16 is drawn together, as is shown in FIG. 1.

Figure 4:
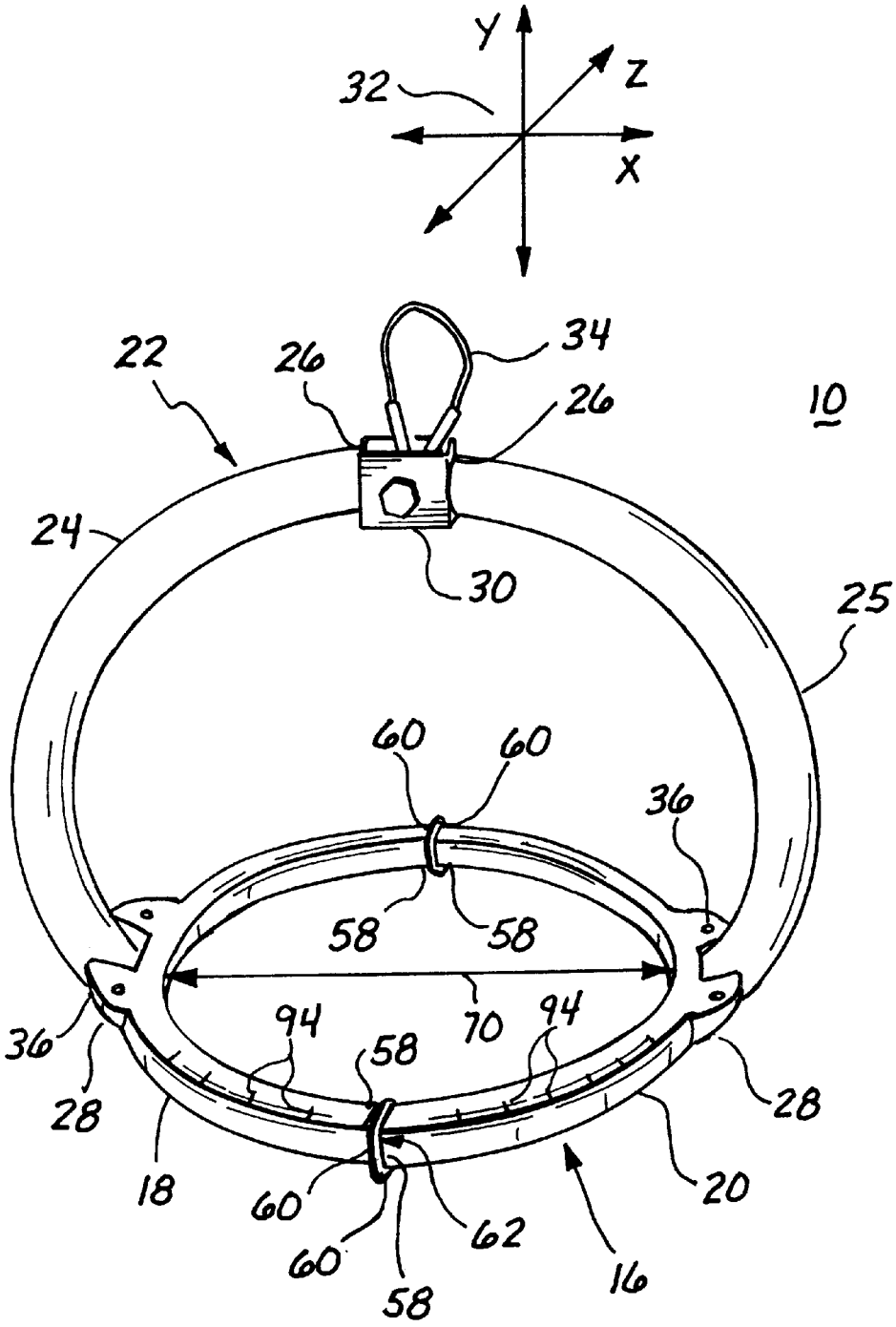
FIG. 4 shows a perspective view of the lifting ring assembly of FIG. 1 without a sand barrel and in the closed position.

Referring now to FIG. 4, the lifting ring assembly 10 is shown without a barrel and with the half ring segments 18 and 20 drawn together, as they are in FIGS. 1 and 2. The contact plates 60 are in contact. Further, a bolt 62 is extending through each set of contact plates 60 (the bolt 62 is only visible in the nearer shown contact plates). In a preferred embodiment of the invention, the bolt 62 is a hot dipped galvanized bolt with oversized threads such that the bolt may be tightened by hand after the split ring 16 is closed about a barrel. Other embodiments of the invention may have suitable means for securing the contact plates 60 together. The split ring 16 has an inner diameter 70.

Figure 5:
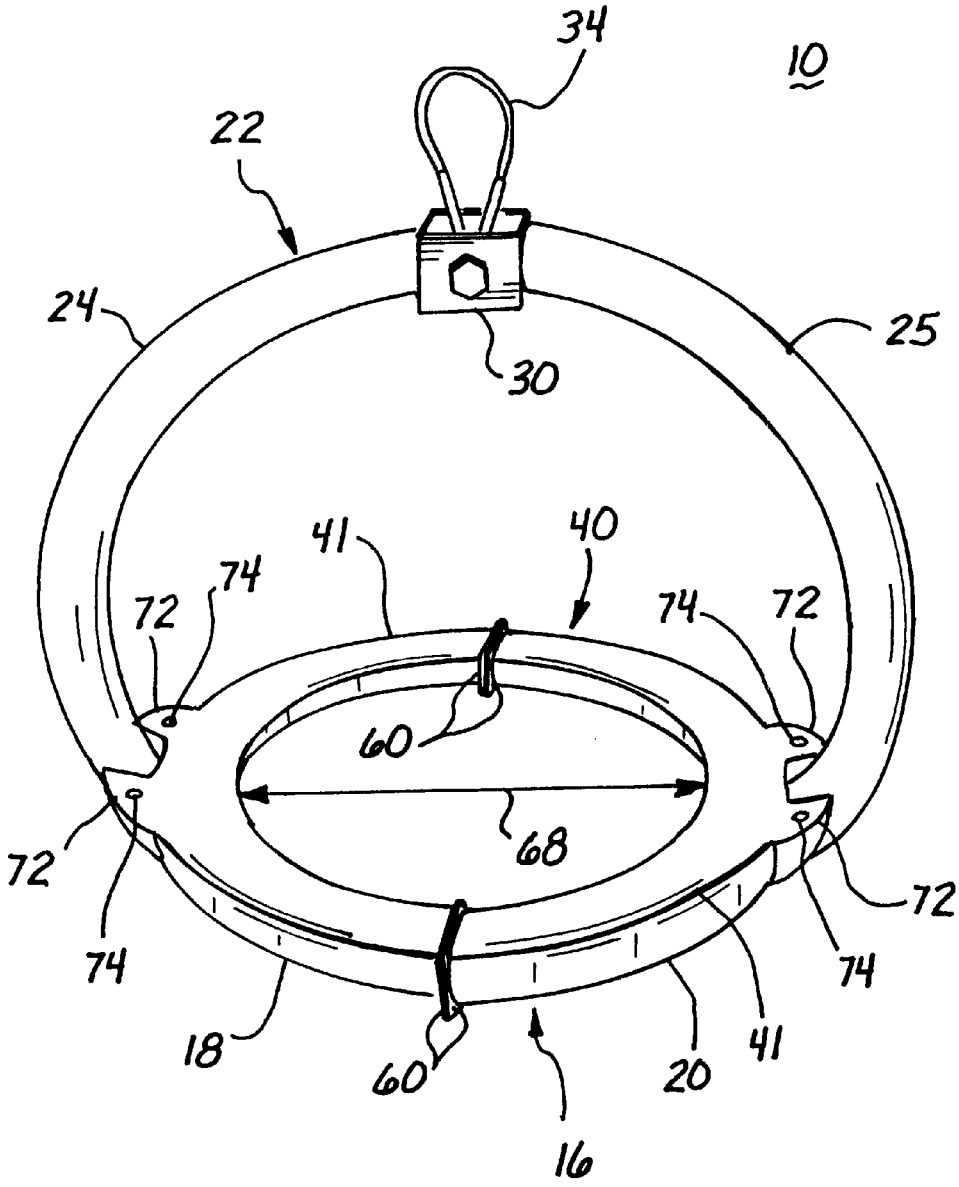
FIG. 5 shows a perspective view of the lifting ring assembly of FIG. 2 without a sand barrel, with the split ring insert, and in the closed position.

Referring now to FIG. 5, the lifting ring assembly 10 is shown with the split insert ring 40 disposed on top of the split ring 16. The split ring insert 40 is comprised of two half annular plates 41 that rest on the top surface of the split ring 16. The installation of the split ring insert 40 in the assembly 10 results in an assembly inner diameter 68 that is smaller than the inner diameter 70 (see FIG. 4) of the assembly 10 without the insert. The resulting smaller assembly inner diameter 68 permits lifting sand barrels of smaller diameters compared to the assembly 10 without the insert 40. Other embodiments of the invention may have multiple inserts 40 of different dimensions that would enable a plurality of various resulting inner diameters.

The split ring insert 40 also has four radial extending tabs 72 located at the midpoint of each split ring half annular plate 41. The tabs 72 straddle the arms 24 and 25 and align with and complement the insert attachment tabs 36 of the split ring 16. As is shown in FIG. 4, the insert attachment tabs 36 extend radially and straddle arm bottom ends 28. A bolt 74 extends through each of the paired tabs 36 and 72 to secure the insert 40 to the ring 16. Other embodiments of the invention may have other suitable means for securing the tabs together, such as pins. Still other embodiments of the invention may have other means for securing the split ring insert 40 to the split ring 16 besides the tab 36/72 arrangement. Still further embodiments of the invention may have other means of reducing the inner diameter of the split ring 16.

Figure 6:
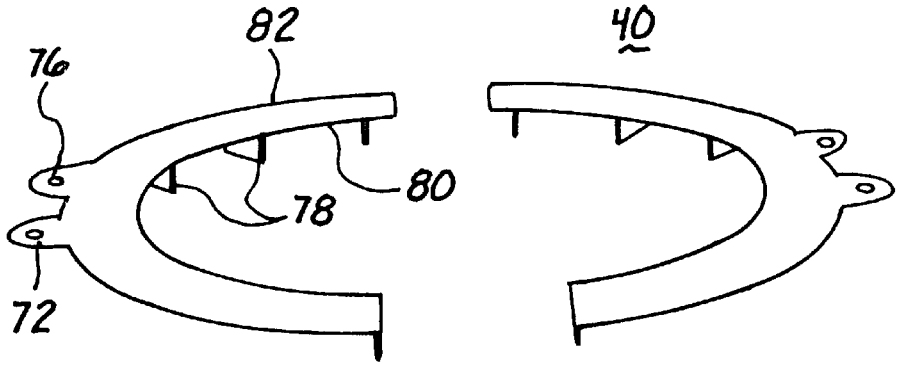
FIG. 6 shows a perspective view of the split ring insert of FIG. 2.

Referring now to FIG. 6, the split ring insert 40 is shown apart from the other components of the assembly 10. Holes 76 for accepting the bolts 74 are shown on the radial extending tabs 72. Stability members 78 are shown extending from the bottom of the split ring insert 40. The stability members 78 are circumferentially spaced about the underside and radially extend from the inner perimeter 80 of the split ring insert 40 to approximately half way to the outer perimeter 82 of the insert 40. The function of the stability members 78 is explained below in conjunction with FIG. 8.

Referring now to FIG. 7, details of the split ring 16 drawn up to the radial extension 14 of the bigger diameter barrel 12 is shown. The split ring 16 is formed from a curved tube 84 and a curved piece of angle 86. In a preferred embodiment of the invention, the split ring 16 is fabricated by bending an aluminum tube into a circle. The circle is divided into two halves to form a portion of each half ring segment 18 and 20. The curved surface of the circle halves would not alone make full contact with the planar horizontal underside 88 of the radial extension 14. To increase the ring/radial extension contact surface area, a piece of angle 86 is curved to match the inner, upper portion 90 of the tube 84. To assist in bending the aluminum angle, the horizontal leg 92 of the angle may have slits 94 cut into it, as shown in FIGS. 1, 3 and 4.

When the split ring 16 is drawn up, as shown in FIG. 7, the planar horizontal underside 88 has a relatively large amount of contact with the horizontal leg 92 of the curve angle 86 compared to if the tube 84 was directly drawn up against the underside 88. The vertical leg 94 of the curved angle 86 also complements the barrel side wall 96 that extends vertically down from the underside 88. The vertical leg 94 not only helps to support the horizontal leg 92, but to stabilize the barrel side wall 96.

Referring now to FIG. 8, the split ring 16 having an split ring insert 40 is shown drawn up against the horizontal underside 88 of the circumferential radial extension 44 of the barrel 38. An inner radial portion 98 of the split ring insert 40 is in contact with the underside 89. The stability members 78 (one shown) have an outer vertical edge 100 that is proximate to the vertical leg 94 of the curved angle 86. This is to provide additional support to the split ring insert 40 when the lifting ring assembly 10 is in use. The inner vertical edge 102 of the stability member 78 also helps to stabilize the barrel side wall 96.

In other embodiments of the invention, any suitable member forming a horizontal lip that extends from the split ring 16 to provide at least partial circumferential contact with the planar horizontal underside 88 of the circumferential radial extension 14 may be used.

Figure 9:
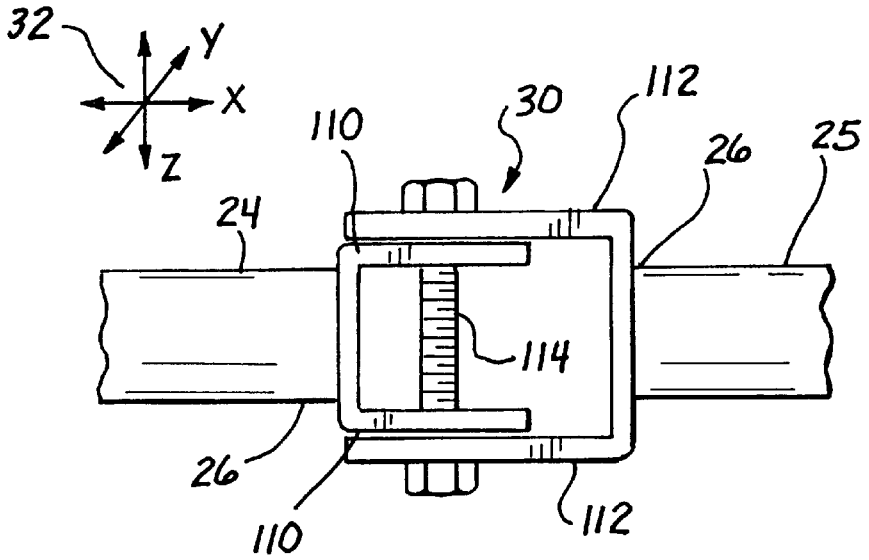
FIG. 9 shows a top view of the pivoting mechanism of the arms of the lifting ring assembly of FIG. 1.

Referring now to FIG. 9, details of the pivot mechanism 30 of the preferred embodiment of the invention are shown. The mechanism comprises a first set of two tabs 110 extending from the top end 26 of the first rigid arm 24 and a second set of tabs 112 extending from the top end 26 of the second rigid arm 25. The sets of tabs 110 and 112 are vertically oriented with the first set of tabs 110 nested between the second set of tabs 112. A bolt 114 is rotatably mounted through the sets of tabs 110, 112 in a horizontal position. The arrangement of the sets of tabs 110, 112, and the bolt 114 permits the rigid arms 24 and 25 to pivot as previously described. It is not shown, but the bolt 114 extends through eyelets on the ends of the cable loop 34 to form the loop. Other embodiments of the invention may use suitable mechanisms for pivoting the rigid arms 24 and 25 and forming the cable loop 34.

In a preferred embodiment of the invention, the lifting ring 10 is designed to be light so that the ring is easily maneuverable. A suitable, light material of construction is aluminum. Other embodiments of the invention may use other suitable materials of construction, such as any other metal, plastic, or composite material. The mechanisms of the preferred embodiments require minimal components. The parts of the lifting ring are welded, and spot welded when appropriate so that heavy fastening devices are not used to fabricate the ring 10. In the preferred embodiment of the invention, the lifting ring assembly 10 weighs only approximately 52 pounds.

In a preferred embodiment of the process for moving a sand barrel, a fork lift carrying the lifting ring assembly 10 by the cable loop 34 positions the ring by a barrel 12. Two people pivot the rigid arms 24 and 25 upwards and bring the split ring 16 about the barrel and below the circumferential radial extension 14. The rigid arms 24 and 25 are pivoted back down and the contact plates 60 at the ends 58 of the half ring segments 18 and 20 of the split ring 16 meet. A person secures the contact plates 60 together. The fork lift is then directed to bring the split ring 16 up and into contact with the underside 88 of the radial extension 14. The fork lift is then directed to lift the entire lifting ring assembly 10 and barrel 12 and move it to an appropriate place. The lifting ring assembly 10 and the barrel 12 are then deposited and the split ring 16 released and removed. This process is repeated to arrange an array of sand barrels.

Although presently preferred embodiments of the present invention have been described in detail hereinabove, it should be clearly understood that many variations and/or modifications of the basic inventive concepts herein taught, which may appear to those skilled in the pertinent art, will still fall within the spirit and scope of the present invention, as defined in the appended claims.

We claim:

1. A lifting ring assembly for lifting barrels having at least a partial circumferential radial extension above an outer diameter, the lifting ring comprising:

a. a split ring comprising two half ring segments having mutually attachable ends, wherein an inner diameter of the split ring is smaller than the outer diameter of the partial circumferential radial extension; and b. a cross brace comprising first and second rigid arms having top ends and bottoms ends, the top ends being mutually pivotally connected by a pivoting mechanism and the bottom ends being fixedly connected to a midpoint of the half ring segments, respectively, such that the cross brace is perpendicularly oriented to the split ring and the rigid arms pivot in a vertical plane.

2. The lifting ring of claim 1, wherein the pivoting mechanism comprises:

a. a tab that extends from each rigid arm top end, the tabs being perpendicularly oriented to the split ring and overlapping in a direction normal to the vertical plane; and b. a pivoting member rotationally mounted through the overlapping tabs in the direction normal to the vertical plane.

3. The lifting ring of claim 2, further comprising a cable loop connected to the pivoting mechanism for lifting the lifting ring without moving the rigid arms relative to each other.

4. The lifting ring of claim 3, wherein the cable loop is adapted to have a fork of a fork lift truck inserted therethrough and lift the lifting ring.

5. The lifting ring of claim 3, wherein the cable loop comprises two ends, each end having an eyelet through which extends the pivoting member.

6. The lifting ring of claim 1, wherein the pivoting mechanism comprises:

a. a first set of two tabs extending from the first rigid arm top end, the first set of two tabs being perpendicularly oriented to the split ring, overlapping in a direction normal to the vertical plane;

b. a second set of two tabs extending from the second rigid arm top end, the second set of two tabs being perpendicularly oriented to the split ring, mutually overlapping and overlapping the first set of two tabs in the direction normal to the vertical plane, and being disposed between the first set of two tabs;

c. a cable loop connected to the pivoting mechanism for lifting the lifting ring without moving the rigid arms relative to each other; and d. a pivoting member rotationally mounted through the overlapping tabs in the direction normal to the vertical plane.

7. The lifting ring of claim 6, wherein the cable loop comprises two ends, each end having an eyelet through which extends the pivoting member.

8. The lifting ring of claim 1, wherein each half ring segment comprises:

a. a tube bent in a generally half circle shape; and b. a curved lip extending radially inwardly from a top surface of the tube for the partial circumferential radial extension to rest on during lifting.

9. The lifting ring of claim 8, wherein the split ring further comprises two semi-circular inserts that are removably attached to respective half ring segments, are disposed on the curved lip, and extend radially inwardly greater than the curved lip, whereby the attached semi-circular inserts reduce the inner diameter of the split ring.

10. The lifting ring of claim 8, wherein:

a. the tube is aluminum; and b. the curved lip is a first leg of a curved aluminum angle, the angle having a second leg extending from an inner edge of the curved lip away from the cross brace and at a generally 90° angle from the first leg.

11. The lifting ring of claim 10, wherein the split ring further comprises two semi-circular aluminum inserts that are removably attached to respective half ring segments, are disposed on the curved lip, and extend radially inwardly greater than the curved lip, whereby the attached semi-circular inserts reduce the inner diameter of the split ring.

* * * * *